US008113961B2

(12) United States Patent
Yu et al.

(10) Patent No.: US 8,113,961 B2
(45) Date of Patent: Feb. 14, 2012

(54) RACE SET

(75) Inventors: Glenn Yu, San Marino, CA (US); Steven Moran, Woodland Hills, CA (US); James W. Mazzolini, Hawthorne, CA (US)

(73) Assignee: Mattel, Inc., El Segundo, CA (US)

( * ) Notice: Subject to any disclaimer, the term of this patent is extended or adjusted under 35 U.S.C. 154(b) by 231 days.

(21) Appl. No.: 11/800,327

(22) Filed: May 4, 2007

(65) Prior Publication Data

US 2007/0298853 A1 Dec. 27, 2007

Related U.S. Application Data

(60) Provisional application No. 60/798,011, filed on May 4, 2006, provisional application No. 60/812,173, filed on Jun. 9, 2006, provisional application No. 60/846,302, filed on Sep. 20, 2006.

(51) Int. Cl.
*A63F 9/14* (2006.01)

(52) U.S. Cl. ..... 463/59

(58) Field of Classification Search ..... 446/429, 446/435, 445, 456, 457, 460, 462, 463; 463/58–62; 700/91; 482/1, 3, 8, 15
See application file for complete search history.

(56) References Cited

U.S. PATENT DOCUMENTS

| | | | | |
|---|---|---|---|---|
| 1,626,620 | A | 5/1927 | Mentzer | |
| 2,165,749 | A | 7/1939 | Engholm et al. | |
| 2,188,948 | A | 2/1940 | Huebner | |
| 3,315,632 | A * | 4/1967 | Hyden | 116/223 |
| 3,565,430 | A | 2/1971 | McRoskey | |
| 3,648,454 | A | 3/1972 | Morrison | |
| 3,707,802 | A | 1/1973 | Tucker, Jr. et al. | |
| 3,834,702 | A | 9/1974 | Bliss | |
| 3,846,704 | A * | 11/1974 | Bessette | 340/870.28 |
| 3,912,259 | A | 10/1975 | Manuel | |
| 3,954,268 | A | 5/1976 | Zyla | |
| 4,010,956 | A | 3/1977 | Zyla et al. | |
| 4,108,437 | A | 8/1978 | DeAnda et al. | |
| 4,216,956 | A | 8/1980 | Yamamura et al. | |
| 4,476,358 | A | 10/1984 | Capecchi | |
| 4,518,266 | A | 5/1985 | Dawley | |
| 4,715,602 | A | 12/1987 | May et al. | |
| 4,785,282 | A * | 11/1988 | Martell et al. | 340/323 R |
| 4,872,680 | A * | 10/1989 | Dennis | 463/59 |
| 5,136,621 | A * | 8/1992 | Mitchell et al. | 377/24.2 |
| 5,162,009 | A * | 11/1992 | Vaughn | 463/60 |
| 5,361,705 | A | 11/1994 | Powell | |
| 5,643,036 | A | 7/1997 | Liu et al. | |

(Continued)

FOREIGN PATENT DOCUMENTS

WO 0189645 A2 11/2001

(Continued)

*Primary Examiner* — David L Lewis
*Assistant Examiner* — Eric M Thomas
(74) *Attorney, Agent, or Firm* — Edell, Shapiro & Finnan LLC

(57) ABSTRACT

In one embodiment, a race set is described. The race set may comprise a portable race management device, comprising: a detachable lane defining element configured to be actuated; a starting indicator; a finishing indicator; and circuitry configured to receive start and/or finish signals via actuation of the detachable lane defining element, control actuation of the starting indicator upon race starting, and control actuation of the finishing indicator upon race finishing. Various alternative embodiments and alternative example race sets are also included.

27 Claims, 6 Drawing Sheets

U.S. PATENT DOCUMENTS

| | | | | |
|---|---|---|---|---|
| 5,676,586 | A | 10/1997 | James | |
| 5,831,940 | A | 11/1998 | Gillette | |
| 5,897,457 | A * | 4/1999 | Mackovjak | 482/8 |
| 6,072,751 | A | 6/2000 | Kirson et al. | |
| 6,380,911 | B1 * | 4/2002 | Eaton | 345/30 |
| 6,494,812 | B1 * | 12/2002 | Grimes, Jr. | 482/14 |
| 6,736,759 | B1 * | 5/2004 | Stubbs et al. | 482/8 |
| 6,837,827 | B1 * | 1/2005 | Lee et al. | 482/8 |
| 6,940,783 | B2 | 9/2005 | Fox et al. | |
| 2003/0073541 | A1 | 4/2003 | Carlson | |
| 2004/0213087 | A1 | 10/2004 | Gillette et al. | |
| 2004/0230639 | A1 * | 11/2004 | Soluk et al. | 709/200 |
| 2005/0097179 | A1 * | 5/2005 | Orme | 709/207 |
| 2006/0217232 | A1 | 9/2006 | Kondrat et al. | |
| 2006/0281541 | A1 * | 12/2006 | Nguyen et al. | 463/25 |

FOREIGN PATENT DOCUMENTS

| | | | |
|---|---|---|---|
| WO | 03063991 | A1 | 8/2003 |

* cited by examiner

RACE SET

CROSS-REFERENCE TO RELATED APPLICATIONS

The present application claims priority to provisional application 60/798,011, filed May 4, 2006, titled "Race Set", claims priority to provisional application 60/812,173, filed Jun. 9, 2006, titled "Race Set", and claims priority to provisional application 60/846,302, filed Sep. 20, 2006, titled "Electronic Racing Game Set". The contents of these provisional applications are incorporated herein by reference.

BACKGROUND

Competitive racing has provided popular entertainment for people of all ages. People enjoy both self competition, as well as side-by-side competition, in a variety of environments, such as running, bicycling, skating, etc.

Accurately measuring and indicating starts and finishes in such competitive racing may present various difficulties. For example, if a racer is required to control the race start, that racer may have an advantage in terms of reaction time, or may be at a disadvantage in terms of readiness to begin racing. Further, if those competing are required to decide the race winner, it may be difficult to remove human biases.

Various systems may be used to control race starting and/or finishing, as well as to determine race times and other race statistics. However, available systems may be limited in that they may not be easily applied to a plurality of race modes, such as lap races and non-lap races. Further, available systems may not enable sufficient portability to enable races to be carried out at a plurality of physical locations and terrains, and may not provide sufficient indicators for starting/finishing under various race modes and race locations.

SUMMARY

In one approach, a race set may be provided comprising a portable race management device. The race management device may comprise: a detachable lane defining element configured to be actuated; a starting indicator; a finishing indicator; and circuitry configured to receive start and/or finish signals via actuation of the detachable lane defining element, control actuation of the starting indicator upon race starting, and control actuation of the finishing indicator upon race finishing.

In another embodiment, a race management device for controlling and measuring starting and finishing events may comprise: a starting indicator; a finishing indicator; a user interface; and a processor configured to select a race mode based on at least one of a lap mode request and a non-lap mode request received via the user interface, and actuate the starting indicator and the finishing indictor based on the selected race mode.

DETAILED DESCRIPTION

Figures 1A, 1B:
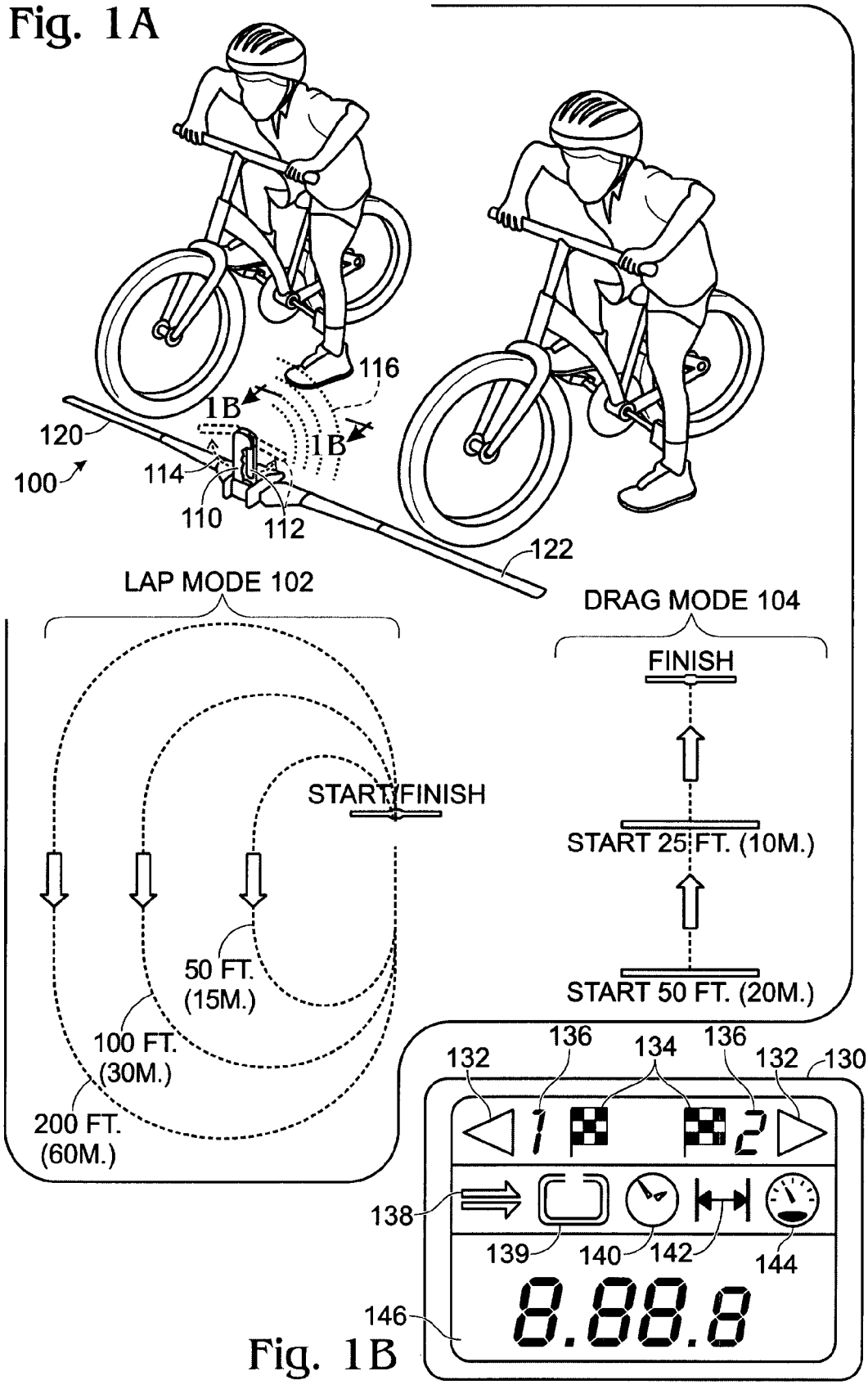
FIG. 1A shows an example race set with two bicycle racers, as well as alternative race modes.
FIG. 1B shows an example display screen and available display elements illuminated.

FIG. 1A shows an example race set in use, the race set including a race management device 100. The race management device 100 includes various components and features that can be used to enable a competitive side-by-side racing or individual racing in a variety of environments, including foot races, bicycle races, etc. The race management device 100 can be used to provide single and multi-loop timed races, lap races, as well as straight line "drag" or distance type races. The race management device 100 may operate as both a starting and finishing device, and display race results such as speed, time, winning lane, etc. Further, during starting, the race management device can provide physical start signals, starting sounds, and further detect false starts. During finishing, the race management device can detect which lane finished first, provide a physical winner signal, as well as generate finishing sounds and/or display finishing data.

As shown in FIG. 1A, the race management device 100 can operate in a lap mode 102 as both a start and finish line (as well as start and finish indicator with start and/or finish sensing) for one or more racers, such as two racers engaged in side-by-side racing. Specifically, the race management device 100 may measure lap time, count laps, and measure speed using pre-programmed race lengths, such as those shown in FIG. 1A. While FIG. 1A illustrates three distances, it should be appreciated that any number and length of loop distances may be used. Further, in the lap mode 102, the race management device 100 may operate to indicate which lane has the fastest time, or in which lane a predetermined number of laps has been performed.

Alternatively, the race management device 100 may operate as a start indicator and finish line/finish indicator for non-lap races, such as drag-style or distance races as shown in mode 104. While FIG. 1A illustrates two different race distances, it should be appreciated that race management device 100 may provide any number of race length distances. Again, the race management device 100 may display race time, lengths, a winning side, as well as race history (such as the fastest time over two or more races), etc., also using pre-programmed race lengths, such as those shown in mode 104.

In one example, the race management device 100 includes a central unit 110 that may include a physical flag, such as starting flag 112 rotatably attached to an upper end of central unit 110, as well as various other signaling units and/or user interface units that may include sound generator units, light generator units, input devices, display devices, etc. Starting flag 112 may include a first and second flag (or first and second sets of flags) that are rotatably coupled to an upper end of central unit 110. During a first condition, the starting flag 112 is folded into central unit 110. Starting flag 112 may be spring loaded and held via a catch such that it is hidden in central unit 110 in a vertical position. Then, upon a selected event, such as a starting signal, finishing signal, lap signal, etc., the starting flag 112 is released and made visible via rotation or pivoting movement into a substantially horizontal position extending perpendicular to a race direction, as indicated by the arrow 114 of FIG. 1A and dashed lines. Alternatively to, or in addition to, the physical flags, sound may also be generated as indicated at 116. The sounds may include starting and/or finishing sounds, such as beeps, or words (e.g., "ready . . . set . . . go", "Lane 1 wins", "False start", etc.), or combinations thereof.

Central unit 110 may have both a first lane 120 and a second lane 122. In one example, the lanes may be positioned perpendicular to a race direction, where the lanes are aligned with respect to one another to form a common starting plane, for example. Alternatively, the lanes may be staggered, such as in lap races, where an outer lane is positioned forward of an inner lane.

In the example of FIG. 1A, each of the first and second lane defining elements (referred to herein as a "lanes") 120, 122 may be removeably or detachably coupled to central unit 110. Such a feature can enable easy transportation and storage, while still providing appropriate functionality for side-by-side racing by bike, foot, etc. Further, to enable such detachable coupling, yet still provide accurate racer detection, first and second lanes 120, 122 may each be rotatably and detachably coupled to central unit 110, such that passage of a racer over the lane results in rotation of the lane that is detected in central unit 110 (See FIG. 4). For example, lanes 120, 122 may be spring loaded in a partially raised and/or inclined position relative to the ground or race surface, such that the weight of a runner's foot, or weight of a bicycle, passing over the lane causes it to rotate. Then, this rotation is translated via an internal mechanism to a processor in central unit 110, such as described in FIGS. 4 and 5, for example. Alternatively, the lanes may utilize various switch, pressure, and/or touch sensors to detect depression of a lane member.

While FIG. 1A shows the first and second lanes 120, 122 as generally planar elongate pads defining a first and second lane, various other shapes and/or configurations may be used. Further, various lane marking indicia may be placed on the lanes, such as a lane number (e.g., "1" and "2"), or other such indicia.

As noted, central unit 10 may include a display device, such as display device 130 that includes a plurality of displays. Display device 130 may enable a user to see visual indicators regarding starting, finishing, race statistics, etc. For example, as shown in FIG. 1B, display device 130 may include a winning lane indicator 132, a checkered flag indicator 134 (which may be illuminated next to a winning lane), a position indicator 136 (indicating "1" for the first place finisher, or "2" for the second place finisher), a mode symbol ("drag/distance" mode 138 or "loop" mode 139), and a display symbol indicating the units (142 time, 144 distance, and 146 speed) of the numerical readout 146. The numerical readout can provide a measured time, measured speed, lap time, lap speed, etc.

While FIG. 1A shows two bicycle riders competing, the system may also be used by runners, rollerbladers, rollerskaters, skateboarders, etc. In such system, touch sensors may enable detection and measurement of the runner and/or their transport vehicle. Further, the touch sensors may be configured to detect contact by racer across substantially the entire lane, or only in specific regions. It should be appreciated that in this example two lanes are illustrated; however, the race management device may be configured to manage a plurality of race lanes, such as three, four, or more.

The race management device 100 may be packaged in a disassembled, fully assembled, or partially assembled condition. For example, the lanes 120, 122 may be detachably coupled to the central unit 110. Further, the display device and/or physical flags may be detachably coupled in the system.

Figure 2A:
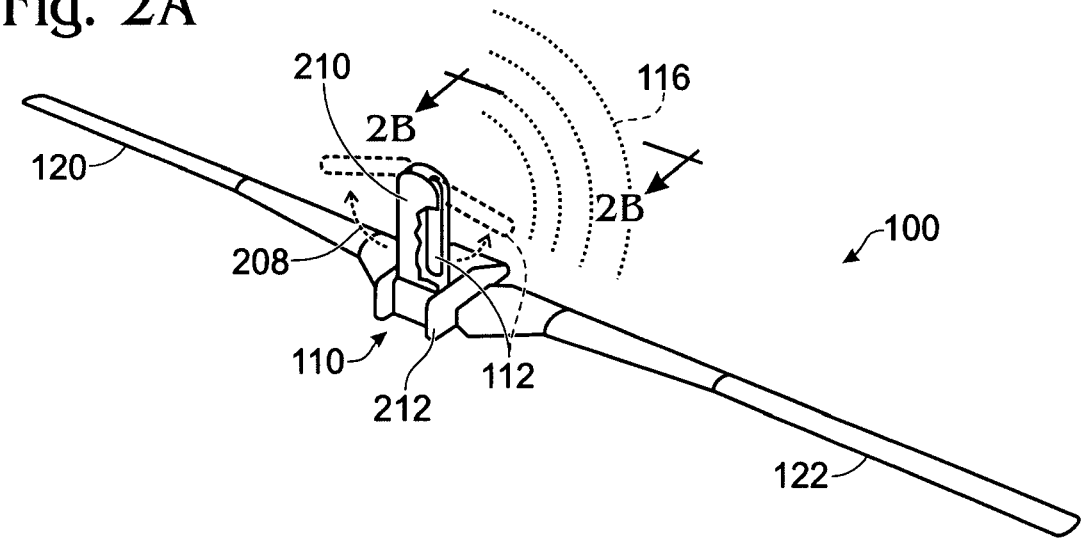
FIG. 2A shows an enlarged view of the race set during a starting event.

Referring now to FIG. 2A, it shows an enlarged view of central unit 110, including tower 210. In one example, tower 210 may be pivotably attached to base 212, and held in position vertically by a releasable securing mechanism (not shown), such as an indent-detent mechanism. This allows the tower 210 to be pivoted back from a vertical position (in use) to a horizontal, reclined, position (storage), generally in alignment with base 212. This may be useful for reducing the unit size for storage and handling. Additionally, it may allow the tower to be knocked over during a race without damaging the tower.

Figure 2B:
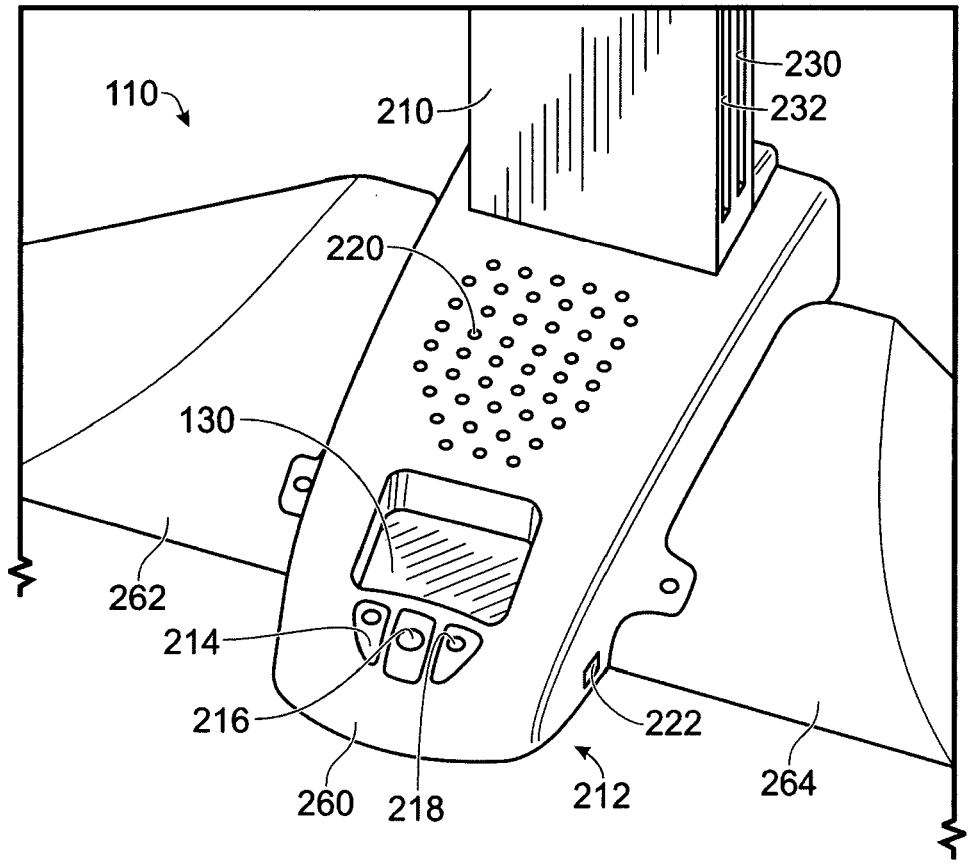
FIG. 2B shows details of an example user interface.

Portions of base 212 and tower 210 are shown in FIG. 2B with an example user interface, which may include display device 130, and input buttons 214, 216, and 218. Base 212 is shown having a center base section 260 coupled to first arm 262 and second arm 264. In this example, input button 214 may be a menu button, input button 216 may be a race button, and input button 218 may be a select button. Further, a speaker section 220 is shown, which may house a speaker for generating sound, alarms, starting signals, and/or voice commands. Further, an on/off switch is shown at 222.

FIG. 2B also shows a first and second slot 230 and 232 on one side of tower 210, with two additional slots on the other side of the tower (not shown). In this example, a starting flag may be positioned in slot 230 and a finishing flag may be positioned in slot 232. While two slots are illustrated, additional slots may be used for additional flags, or a plurality of flags may operate in a single slot.

Figure 2C:
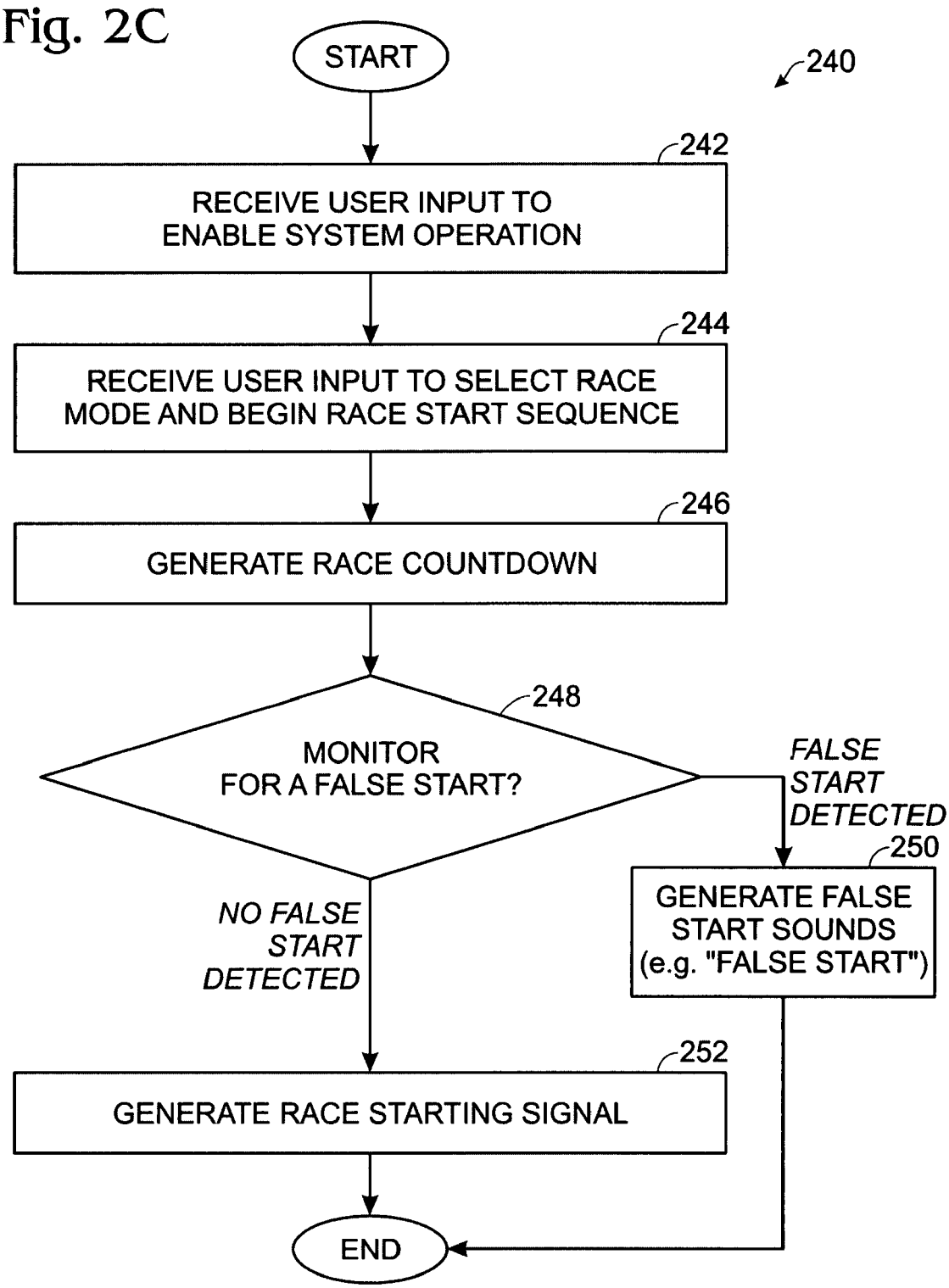
FIG. 2C shows a high-level flowchart of race set operations during a starting event.

Referring now to FIG. 2C, an example starting routine 240 carried out by the race management device 100 is shown. Specifically, during the start, at 242, the race management device 100 first receives a user input to enable system operation via on/off switch 222. Further, it may receive a user input to reset system to pre-race state (e.g., folding starting/finishing flags, etc.).

Next, in 244, the race management device 100 receives a user input via menu button (214) to select a race mode (loop/drag), distance, etc, and then receives a user input via race button (218) to begin race-start sequence. Specifically, pre-stored default settings may be selected by default upon initial power-up of the device (e.g., via actuation of switch 222), and then the user may simply press the race button 218 to begin a racing event using the default settings. Alternatively, the user may press the menu button to display the various options, such as the loop race mode, lap race mode, and/or drag/distance race mode. For example, when the lap mode is displayed via race management device 100, it may receive a user input via the select button 218 to increase the number of laps. At this point, depression of the race button 216 begins a racing event. Alternatively, a user may further adjust the settings in that the race management device 100 may further receive additional input via the menu button 214 to cycle through to the loop race mode. At this point the user may select a distance via the select button 218. Again, at this point, depression of the race button 216 begins a racing event. In still another alternative, the user may further press the menu button 214 to cycle through to the drag/distance race mode. At this point the user may select a distance via the select button 218. Again, at this point, depression of the race button 216 begins a racing event.

At 246, the device generates a race countdown, including "beep" sounds every 5 seconds, and then generates sounds to begin race, including "ready . . . on your marks . . . set . . . ".

Various other sounds and or light indicia may also be used to ready racers to prepare for starting.

During the race countdown, the routine may also monitor for a "false start." For example, as the racers stand behind the lanes, if a racer steps on, or drives over, one of the lanes 120, 122 before a starting signal is generated, the device can detect such actuation via lanes 120, 122 and corresponding sensors. Further, the device may provide and generate false start sounds (e.g., "false start") in 250. Otherwise, if no false start is detected, the device generates race starting signal(s) to signal the racers, and further commences a timer. The race starting signals may include coordinated race sounds (e.g., "go") and/or physical signals. The physical signals may be the display of a flag, such as starting flag 112 via activation of a release mechanism.

Figure 3A:
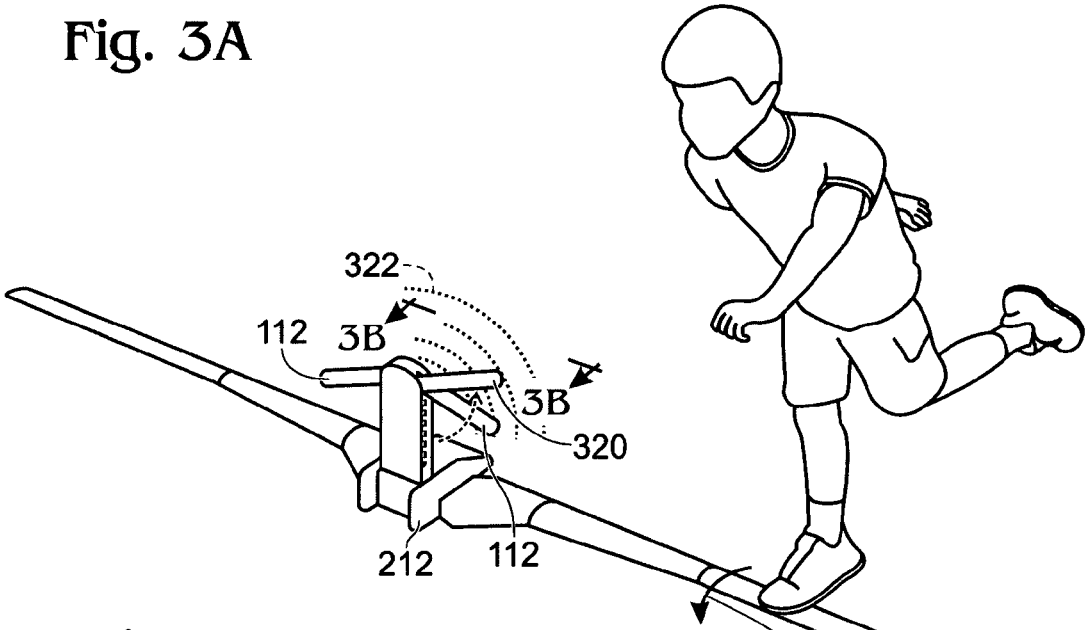
FIG. 3A shows the race set during a finishing event.

Referring now to FIG. 3A, race management device 100 is shown during a finishing event, where a winning runner actuates lane 122. Upon activation of lane 122 by the runner's foot, the lane rotates as shown by arrows 302, thereby activating a bump sensor in base 212 through internal mechanisms as described further with regard to FIG. 4. The activation of the sensor is then detected and processed by internal electronics, which release a catch holding winning flag element 320 on the winning lane side as shown in FIG. 3A based on the sensed information. Winning sounds may be generated based on the sensed information as shown by 322. Further, winning information may be displayed via 130, such as shown in FIG. 3B.

Figure 3B:
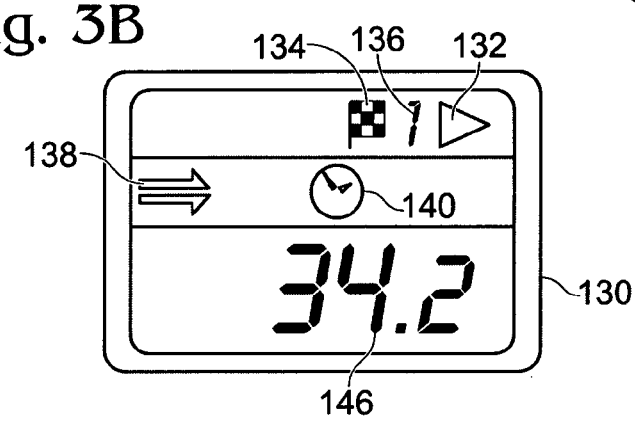
FIG. 3B shows an example display screen upon completion of a race.

In particular, as shown in FIG. 3B, display device 130 may include a winning lane indicator 132 (in this case indicating lane 2 is the winner), a checkered flag indicator 134 (positioned next to the winning lane), a position indicator 136 (indicating "1" for the first place finisher), a mode symbol 138 (indicating "drag" mode in this example), and a display symbol 140 indicating the units of the numerical readout 146. In the example of FIG. 3B, a timer symbol indicates the readout provides the winning time.

Figure 3C:
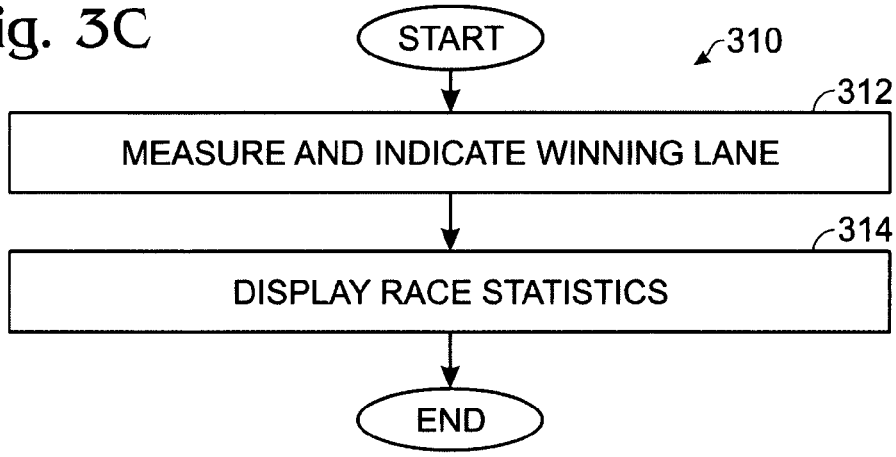
FIG. 3C shows a high-level flowchart of race set operations during a finishing event.

A finishing routine carried out by device 100 is illustrated in FIG. 3C. At 312, the device monitors lane sensors to identify which lane is actuated first (lane 1 or lane 2) and then generates a flag on the winning side with or without audible finish signals. Next, in 314, the device may display race statistics, such as winning time, winning lane, speed, first or second place, etc. In one example, the device may display race results upon receiving a user input, such as via menu button 214. Note that if the button is pressed initially after the unit is turned on, results of the most recently completed race may be displayed.

While the above is one example finishing routine, various alternatives may also be used. For example, the device may include a sensor lock-out feature, where during a predetermined duration (e.g., a predetermined time) following a race start, sensor inputs are ignored to reduce the likelihood of erroneous finishing indications. Thus, when racers are riding vehicles, such as bicycles, having more than one wheel, initial and subsequent actuation after a start may be ignored and erroneous finish indications may be reduced.

Figure 4:
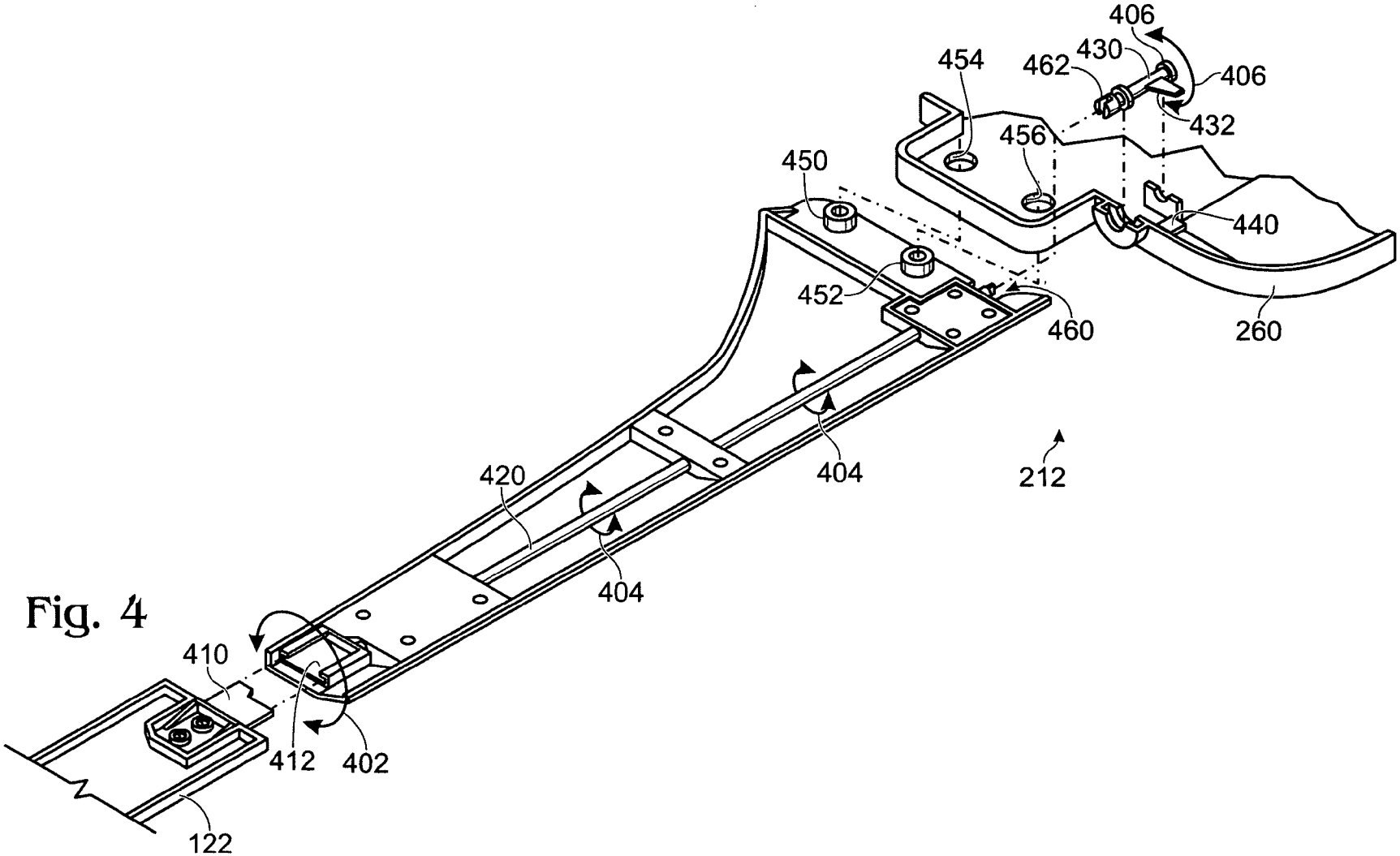
FIG. 4 shows an exploded view of a portion of the race set.

Referring now to FIG. 4, an exploded underside view of a portion of race management device 110 is shown. A portion of base 212 is shown, including arm 242 and a portion of center base section 260, coupled to lane 122. In this example, rotation of lane 122 as indicated by arrow 402 (which may be caused by a user running or riding over lane 122) is translated through center base section 260 via rotation of rod 420 as shown by arrows 404. This rotation is translated through key 430, as shown by arrow 406, in which key protrusion 432 operates as a lever arm to actuate a bump sensor 440. In this way, actuation by a user can be reliably sensed under a variety of different types of racing, while still providing a detachable construction to enable easy transport of the race sent. Further, in this particular example, the detachable construction is provided without requiring disconnection of any electrical connects, such as wire connectors, etc.

As noted, FIG. 4 shows an exploded view, where arm 242 includes a screw-mounted protrusion 410 that slideably mates to a corresponding receptor 412 mounted an end of rod 420 to enable a repeatedly detachable coupling. Further, arm 262 is mounted to center base section 260 via two male pins 450 and 452, which may detachably mount to corresponding holes 454 and 456, respectively. Also, rotation of rod 420 is translated to key 420 via a flat-head driver protrusion 460 that mates to a corresponding slot 462.

In the embodiment of FIG. 4, device 100 may operate to receive mechanical actuation of a racer through rotation of lane 122, translate this motion mechanically and via rotation through a detachable coupling to a lever arm which actuates an electrical bump sensor to generate an electrical signal. The signal is transmitted to electronic circuitry, such as a processor as shown in FIG. 5, which then generates various electronic outputs, such as a signal to an electrically actuated catch release which releases a physical flag.

Figure 5:
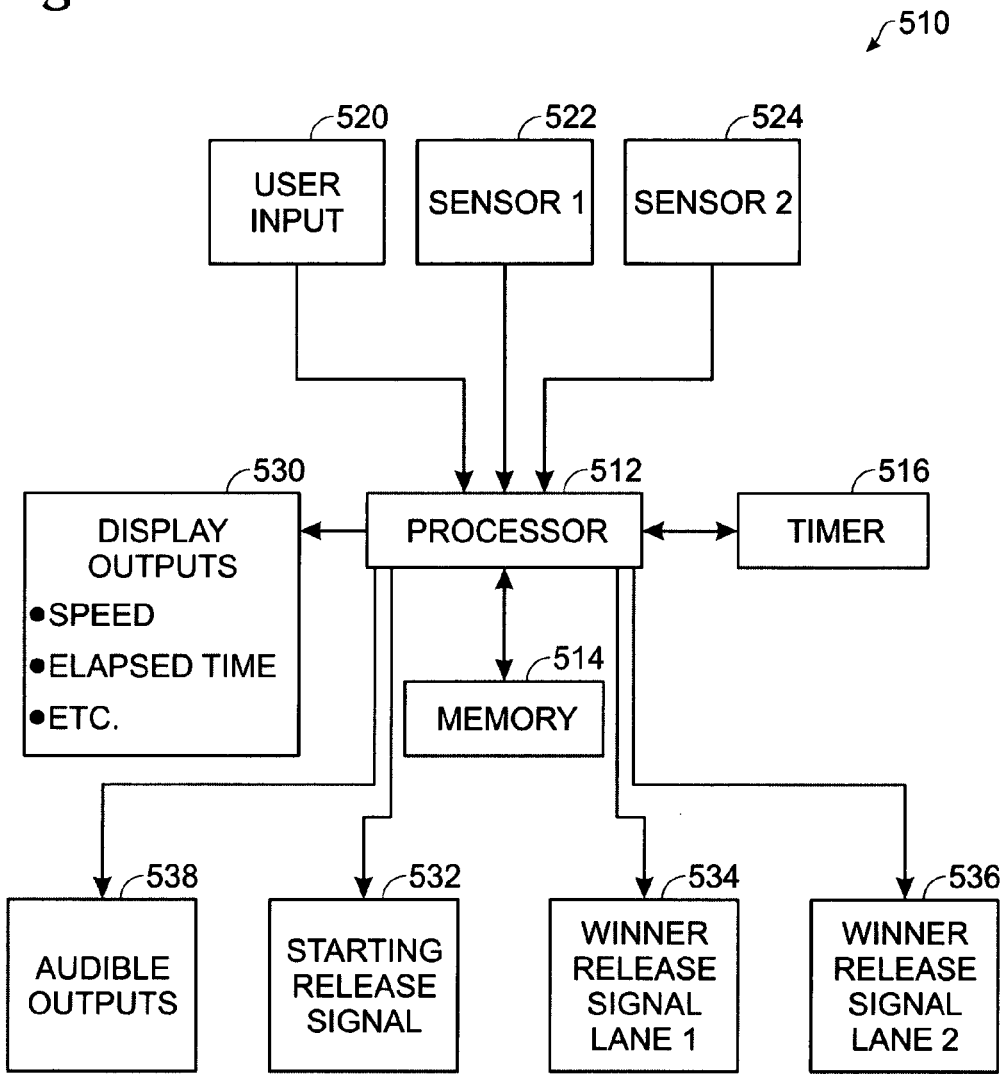
FIG. 5 shows an example processor block diagram of components of the race set.

FIG. 5 shows an exemplary block diagram of an information and control system 510 that may be implemented in electronics and/or code contained on a computer readable storage medium. In one example, system 510 may be mounted in base 212 and portions may be included in lanes 120, 122. The system may include a processor 512 operatively connected to a memory 514, a timer 516, one or more inputs 520, 522, and 524 and one or more outputs 530, 532, 534, 536, and 538. Exemplary inputs may include a user input 520 for beginning a race or setting, resetting and controlling operation of system 510, such as through buttons 214, 214, and 218 as noted herein. Alternatively, input 520 may be one or more keys, such as keys of a keypad or switches. This may allow a user to start a timer on the racer, or input a distance of a race between start and finish line indicators, select a race mode, and others. Other inputs may be one or more sensors 522 and 524, which may represent bump sensors, such as illustrated in FIG. 4, where sensors 522 and 524 may be configured to sense the passage of a racer across lanes 120 and/or 122. As noted herein, alternative examples of such sensors may include a pressure sensitive sensor mounted in lane 120, 122, positional sensors, light sensors, etc. These sensors may detect the passage of a wheel over the sensor or the placement of a racer's foot on the pad over the sensor, such as via rotation of the lane as shown in FIG. 4. Optionally, other forms of sensors may be used, such as a motion detector, or other mechanical elements that are moved when a racer passes over the finish line.

FIG. 5 shows various outputs that may be included, including visual display outputs 530 which may be indicated via display 130. As noted, the display outputs may include an average race speed of a racer (such as the winner), an elapsed time, race mode, finishing place, and various others. Further, the processor may also provide audible outputs 538, such as via the speaker 220. Still other outputs may be controlled via processor 512, such as actuation signals to cause physical signals, such as a starting flag release signal 532 (which in one example may cause the release of two catches, and thus two starting flags, such as shown in FIG. 1), a lane 1 winner flag release signal 534, and/or a lane 2 winner flag release signal. The release signals may be sent to actuators which release a catch holding a spring loaded flag, such as upon release, the pre-compressed spring causes rotation of a flag into a displayed position. In other words, sensor 522 may be coupled to lane 120 and sensor 524 may be coupled to lane 122, output signal 523 may be coupled to starting flag 112, output signal 534 may be coupled to lane 2 winner flag 322, and output signal 536 may be coupled to a lane 1 winner flag (not shown).

In one example, system 510 can operate to control operation of device 100 in the following way. First, system 510 can receive user input via 520, such as a desired race mode, and whether to begin a race event. Then, processor 512 can monitor sensors 522 and 524 for false starts while generating pre-race outputs via outputs 530 and 535. Next, upon finishing pre-race outputs, a race starting output may be generated via outputs 532. Next, the processor 512 can monitor race duration via timer 516, while monitoring sensors 522 and 524 for a first to be actuated. Then, the first actuated sensor may be measured and the device may determine a winning lane, and generate a further output via either output 534 or 536, depending on which sensor of 522 and 524 was the first to be actuated. As noted, various outputs may be provided, and the outputs may vary depending on the race mode, etc.

While the present invention has been described in terms of specific embodiments, it should be appreciated that the spirit and scope of the invention is not limited to those embodiments. For example, the disclosed race set may include a single device that operates as either or both of a finish and start line, or may include separate start and finish lines. The scope of the invention is instead indicated by the appended claims. All subject matter which comes within the meaning and range of equivalency of the claims is to be embraced within the scope of the claims.

The invention claimed is:

1. A race management device, comprising:

a base unit;

a first lane defining element being coupled to and extending from the base unit, the first lane defining element being movable relative to the base unit and actuatable by a first user at the start of a race and by the first user at the end of the race;

a second lane defining element being coupled to and extending from the base unit in a direction opposite to the direction in which the first lane defining element extends, the second lane defining element being movable relative to the base unit and actuatable by a second user at the start of the race and by the second user at the end of the race, the first lane defining element being movable relative to the base independent of any movement of the second lane defining element relative to the base; and a control system, the control system including a sensor and a processor, the sensor being configured to detect actuation of either of the lane defining elements by a user, the processor being configured to control the generation of an output in response to said detection, the output indicating which of the lane defining elements is actuated first at the end of the race.

2. The race management device of claim 1, wherein the sensor is a first sensor, the first sensor detecting engagement of the first lane defining element by the first user, the race management device further comprising:

a second sensor, the second sensor being configured to detect engagement of the second lane defining element by the second user.

3. The race management device of claim 1, further comprising:

a starting indicator, the control system being configured to monitor for a false start signal occurring before actuation of the starting indicator and to generate a false start indicator in response to the monitored false start signal.

4. The race management device of claim 1, wherein the base unit includes a rotatably mounted element that is positioned for selective engagement with the sensor, and one of the first lane defining element or the second lane defining element is operatively coupled to the rotatably mounted element such that actuation of the one of the first lane defining element or the second lane defining element causes the rotatably mounted element to engage the sensor.

5. The race management device of claim 1, wherein one of the first lane defining element or the second lane defining element is a generally flat elongate member, and the one of the first defining element or the second lane defining element is disposed at an angle relative to a surface on which the base unit is placed.

6. The race management device of claim 2, wherein each of the first lane defining element and the second lane defining element is rotatably coupled to the base unit, and the first sensor and the second sensor are configured to detect rotation of the first lane defining element and the second lane defining element, respectively.

7. The race management device of claim 2, wherein the base unit includes a center base section, a first arm, and a second atm, the first arm being detachably coupled to the center base section, the second aim being detachably coupled to the center base section, the first lane defining element being detachably coupled to the first arm and extending away from the center base section, and the second lane defining element being detachably coupled to the second arm and extending away from the center base section.

8. The race management device of claim 2, wherein the base unit includes a first element and a second element, the first element being rotatably mounted on the base unit and positioned for selective engagement with the first sensor, the second element being rotatably mounted on the base unit and positioned for selective engagement with the second sensor, the first lane defining element being operatively coupled to the first element, and the second lane defining element being operatively coupled to the second element, movement of the first lane defining element causes the first element to engage the first sensor and movement of the second lane defining element causes the second element to engage the second sensor.

9. The race management device of claim 7, wherein the first arm includes a first rod extending therealong and mounted for rotation, the second arm includes a second rod extending therealong and mounted for rotation, the first rod being operatively coupled to the first lane defining element, the second rod being operatively coupled to the second lane defining element, and movement of the first lane defining element causes rotation of the first rod, and movement of the second lane defining element causes rotation of the second rod.

10. The race management device of claim 8, wherein the first includes a first rod extending therealong, the second arm includes a second rod extending therealong, the first rod being operatively coupled to the first lane defining element and to the first element, the second rod being operatively coupled to the second lane defining element and to the second element, and movement of the first lane defining element causes movement of the first rod and movement of the first element, and movement of the second lane defining element causes movement of the second rod and movement of the second element.

11. A race set, comprising:

a central base unit;

a first lane defining element being coupled to and extending from the base unit, the first lane defining element being rotatable relative to the base unit and actuatable by a first user at the start of a race and by the first user at the end of the race;

a second lane defining element being coupled to and extending from the base unit in a direction opposite to the first lane defining element, the second lane defining element being rotatable relative to the base unit and actuatable by a second user at the start of the race and by the second user at the end of the race, the first lane defining element being rotatable relative to the central base unit independent of the movement of the second lane defining element; and a control system configured to detect rotation of the lane defining elements and provide an output upon a first actuation of one of the lane defining elements, said output identifying said actuated lane defining element.

12. The race set of claim 11, wherein the first lane defining element is detachably coupled to the base, the first lane defining element being configured to move relative to the base upon engagement by the first user.

13. The race set of claim 12, further comprising:

a sensor, the sensor being configured to detect movement of the first lane defining element relative to the base, the sensor being connected to the control system.

14. The race set of claim 11, where the control system is further configured to receive a user input selecting a race mode, the race mode including at least a lap mode and a distance mode.

15. The race set of claim 11, further comprising:

a starting indicator that includes a rotatable physical flag.

16. The race set of claim 11, where at least one of the lane defining elements is physically detachably coupled in the race management device without an electrical connection.

17. The race set of claim 11, wherein the first lane defining element is a generally flat elongate member positioned at an angle relative to a race surface on which the race set rests.

18. The race set of claim 15, further comprising:

a finishing indicator that includes a rotatable physical flag, the control system controlling actuation of the finishing indicator based on the lane defining element that is actuated.

19. The race set of claim 18, where the control system includes a processor configured to receive user input via a plurality of buttons, and the processor further receives an actuation signal via actuation of one of the lane defining elements, and generates output signals to release at least one of the starting and finishing indicators based on the actuation signal via actuation of one of the lane defining elements.

20. A race management device, comprising:

a first elongate, generally flat, lane defining element configured to be actuated by rotation;

a second elongate, generally flat, lane defining element configured to be actuated by rotation, where the first and second lane defining elements are each inclined relative to a race surface on which the race management device rests; and a central unit coupled between the first and second lane defining elements, the first lane defining element being rotatable relative to the central unit independent of any movement of the second lane defining element relative to the central unit, the central unit having a sound generating output, a user interface, and a processor, the processor configured to receive start and/or finish signals via actuation of the lane defining elements and send output sound signals to the sound generating output.

21. The race management device of claim 20 wherein the central unit includes a rotatable tower configured to be positioned in a first, upright position, and a second, reclined, position.

22. The race management device of claim 20 wherein the lane defining elements are detachably coupled to the central unit without an electrical connection.

23. The race management device of claim 20, wherein the central unit includes a spring-loaded, rotatable shaft coupled to the first lane defining element and a bump sensor, where actuation of the first lane defining element rotates the shaft and causes the bump sensor to generate an electrical signal.

24. The race management device of claim 20, wherein the central unit includes a physical starting flag and a physical finishing flag, and the processor controls actuation of the flags.

25. The race management device of claim 20, wherein the first lane defining element is actuatable by a first user at the start of a race and by the first user at the end of the race, and the second lane defining element is actuatable by a second user at the start of the race and by the second user at the end of the race.

26. The race management device of claim 24, wherein the physical starting and physical finishing flags are rotatably coupled to the tower.

27. The race management device of claim 23 where the user interface provides race statistics.

* * * * *